United States Patent [19]

Dicker

[11] Patent Number: 5,038,999

[45] Date of Patent: Aug. 13, 1991

[54] CONTINUOUS MAILER ASSEMBLY

[76] Inventor: David Dicker, 41 Penny La., Scarsdale, N.Y. 10583

[21] Appl. No.: 567,179

[22] Filed: Aug. 14, 1990

[51] Int. Cl.[5] ..... B65D 27/10

[52] U.S. Cl. ..... 229/69; 282/11.5 A

[58] Field of Search ..... 229/69; 282/11.5 A, 282/11.5 R

[56] References Cited

U.S. PATENT DOCUMENTS 4,095,695 6/1978 Steidinger ..... 229/69
4,108,352 8/1978 Peschke ..... 282/11.5 A
4,492,334 1/1985 Dicker ..... 229/69
4,705,298 11/1987 Van Malderghem et al. ..... 229/69
4,844,329 7/1989 Dicker ..... 229/69

*Primary Examiner*—Stephen P. Garbe
*Attorney, Agent, or Firm*—Martin J. Spellman, Jr.

[57] ABSTRACT

An improved tentless continuous mailer assembly including front and back plies, one of the plies having die-cut apertures extending a short distance inwardly from the left and right margins, the other ply having a longer die-cut aperture extending between the short apertures such that each mailer is connected to an adjacent mailer by the equivalent of only one ply.

2 Claims, 3 Drawing Sheets

CONTINUOUS MAILER ASSEMBLY

FIELD OF THE INVENTION

This invention relates to an improved tentless continuous mailer assembly and a method of fabricating a tentless continuous mailer assembly.

It has been known to manufacture continuous mailer assemblies and similar business forms of multiple plies, such as described in U.S. Pat. Nos. 4,095,695 and 4,108,352 and to fold these assemblies into a stack for shipment purposes. In many cases, when a continuous assembly of this nature is being manufactured, the various plies are brought together and secured to each other via glues or adhesives which set at some point after bringing of the plies together. A final set of the adhesive or glue does not take place until some time after the assembly has been folded into a stack. As a result, the set adhesive or glue tends to retain the plies in a fixed condition relative to each other so that when the assembly is folded out from a stack, a peak or "tent" appears at the folds of the assemblies where the various plies are secured together.

"Tenting" presents a problem in the unfolded condition of a continuous assembly of the above type since automated equipment which process the assembly usually has pin wheels which register in pin holes along the side edges of the assembly in order to pass the assembly through the equipment. If a "tent" occurs in the assembly, registration of the pins in the sides of the assembly may not always occur. It is then possible for the assembly to lift away from the automatic equipment causing a jamming. In addition, "tenting" may cause a pick-up of the edges of the assembly plies about the tent to such an extent that the assembly can be torn by the automated equipment.

The tenting can also catch on the ink ribbon or the hammer slots or the type itself of the automatic equipment causing a jamming. The tenting can also cause a sufficient buildup of thickness so that equipment sensors will cause the equipment to stop since it senses that the forms are too thick to be processed.

PRIOR ART

Various attempts have been made to eliminate "tenting" from continuous business forms and assemblies. In U.S. Pat. No. 4,108,352 plies of material are held together via glue and in the intermediate plies are completely severed along adjacent edges to eliminate a bend in the intermediate ply at the fold of the assembly. The front and back plies, however are not completely severed. Thus, the connecting portions between adjacent sections of each of the front and back plies may still cause a tenting effect to occur.

In my earlier patent U.S. 4,492,334, a continuous mailer assembly was provided with mailer units in which one of the back or front plies was either completely severed from the adjacent ply or connected to the adjacent ply by a weak hinge connection. This somewhat minimized tenting but did not fully eliminate the difficulties of tenting because proper severing did not always occur in manufacturing due to the fact that perforation had to fall exactly in line with a previously laid down perforation.

In my prior patent U.S. Pat. No. 4,844,329, in fabricating the mailer assembly one of the superimposed webs, being either the front or back ply of the envelope is die cut at longitudinally spaced intervals. A strip of approximately 1/16th inch of paper is removed; extending between the removable marginal strip perforations on the left and right sides. The webs of paper comprising the front and back of the envelope when superimposed were adhesively secured to each other within the longitudinally spaced intervals forming the envelope. Then, a perforating blade cut the front and back plies simultaneously, perforating the entire width of the ply that did not get die cut, and only the removable marginal strips on the left and right sides of the ply that is die cut. The perforating blade passed through the 1/16 inch die cut opening. This occurred at each fold of the stack of mailer assemblies.

The unconnected sections do not interfere with the folding and unfolding of the mailer assembly into and from a stacked array. Since all of the die-cutting was on one ply, the web of paper could easily tear apart during high speed manufacturing of the mailer assembly, and because of this, only heavier papers could be used safely in high speed assemblies. With the present invention, very thin papers may be used, which is more desirable for clearer computer imaging, and high speed manufacturing.

An object of the present invention is to provide a continuous mailer assembly which is able to lie flat without tenting, does not rely on a previously laid down perforation to line up with a subsequent perforation, and which does not tear apart during high speed assembly, especially when using thinner papers.

SUMMARY OF THE INVENTION

The invention provides a continuous mailer assembly which is comprised of a plurality of interconnected units that can be disposed in stacked array and with each unit including a front ply, a back ply secured to the front ply to define an envelope, and at least one insert ply within the envelope.

In the present invention, in order to fabricate the improved mailer assembly, both of the superimposed webs, being the front and back plies of the envelope are die cut at longitudinally spaced intervals. One of the superimposed webs may have die cut starting at the left marginal strip and extending to the right, a short distance, and also a second die cut starting at the right marginal strip and extending to the left, a short distance. The other superimposed web, being either the front or back ply of the envelope will have its die cut shortened by the sum of the short distance die cuts which is the total of the two relatively short die cuts of the other web. The sum total of the die cuts on both webs will add up to and appear as one single die cut extending between the removable strip perforations on the left and right sides. The die cut strips of both superimposed webs may vary in length as long as the total length is the equivalent of a single continuous uninterrupted die cut strip extending between the removable strip perforations on the left and right sides. Thus, a total equivalent of one ply of one unit is unconnected with a respective ply of an adjacent unit, while the other equivalent ply of the unit is connected with a similar ply of an adjacent unit in an interrupted manner, e.g. via perforations or the like.

The mailer assembly is constructed so that the equivalent of one ply of adjacent units being unconnected the assembly can be folded and subsequently unfolded without any tenting occurring between the adjacent units. The connections which remain between the plies permits hinging of the respective units together in the equivalent only a single ply. As a result, folding and unfolding of the units can be readily carried out in an unrestrained manner, i.e. without any restraint from the unconnected sections of plies.

In order to fabricate the mailer assembly, the webs of paper have to be superimposed. A first one of the superimposed webs, being either the front or back ply of the envelope, is die cut at longitudinally spaced intervals. A strip approximately 1/16th inch wide of paper is removed; extending from a relatively short distance inwardly from one removable marginal strip on the left side to a relatively short distance inwardly from the removable marginal perforation on the right side.

The second one of the superimposed webs is die cut to remove strips approximately 1/16 inch wide from a relatively short distance inwardly from the right marginal perforation to the right marginal perforation and also a strip from a relatively short distance inwardly from the left marginal perforation to the left marginal perforation. The die cut web sections when superimposed on each other will be the equivalent of a single continuous die cut strip removed between the marginal strips.

The webs of paper comprising the front and back of the other within the longitudinally spaced intervals forming the envelope. Then, a perforating blade will cut the front and back plies simultaneously perforating the entire width of the plies that did not get die cut and the removable marginal strips on the left and right sides of the ply that is die cut. The perforating blade passes through the 1/16 inch die cut openings. This occurs at each fold of the stack of mailer assemblies.

The unconnected sections will not interfere with the folding and unfolding of the mailer assembly into and from a stacked array. The 1/16 inch strips of paper from the plies taken together, extend between the removable marginal strip perforations on the left and right sides, so that just the equivalent on just one ply of the envelope hinges at the fold. The strip is die cut in a known manner prior to bringing the front and back and other plies together in registration with each other.

The continuous mailer assembly may also have more than one insert ply between the front and back plies.

The formed assemblies can be folded at those places where the adjacent sections of webs are unconnected to each other in a zig-zag manner to form a stack. When so folded, each layer of the stack may have two or more mailer units therein. In such cases, only those sections of a ply where folding is to occur need to have unconnected strips.

When the mailer assembly is unfolded from a stacked array, for example, for feeding into an automatic processing machine, no "tenting" occurs between the individual units of the assembly. This results because sections of the back plies and the front plies totaling the equivalent of one uninterrupted strip are unconnected to each other except at the marginal strips.

As with known mailer assemblies, the assembly can be provided with an overlying ply which, after feeding through an automatic processing machine, can be retained for audit purposes while the mailer units are mailed. Further, each of the webs may be provided with control pin holes along the side edges in order to facilitate processing in automatic equipment.

These and other objects and advantages of the invention will become more apparent from the following detailed description taken in conjunction with the accompanying drawings:

BRIEF DESCRIPTION OF THE DRAWING

In the accompanying drawing which forms a part of the specification.

ILLUSTRATIVE SPECIFIC EMBODIMENT

Figure 1:
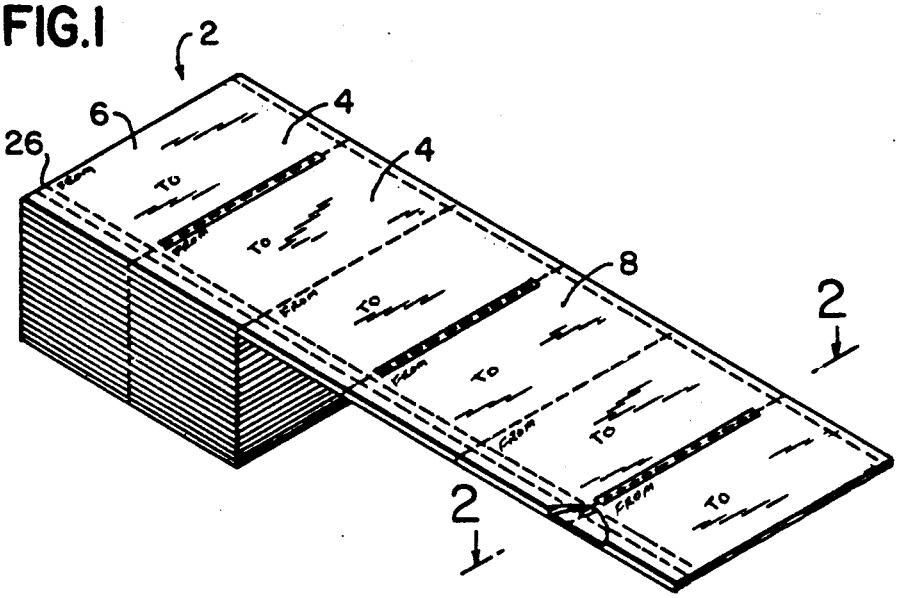
FIG. 1 illustrates a continuous mailer assembly constructed in accordance with the invention.
Figure 2:
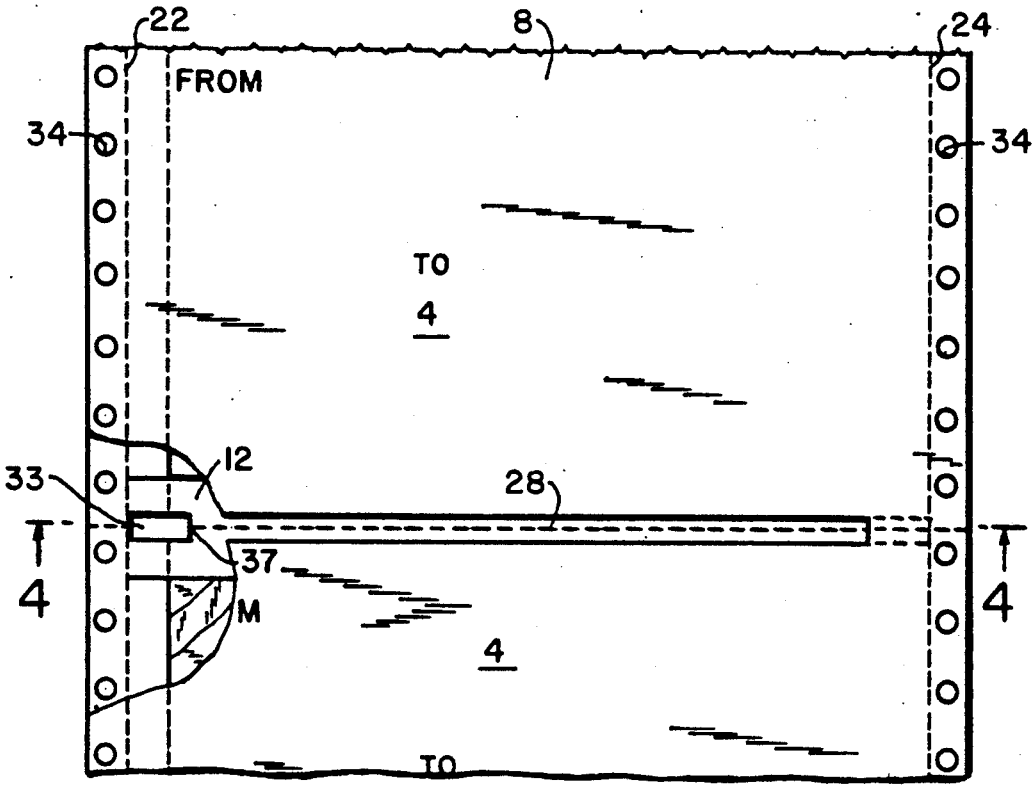
FIG. 2 illustrates a top plan view of two adjacent units of a continuous mailer assembly according to the invention with a portion of the front sheet cut away to show the back sheet die cut along lines 2—2 of FIG. 1.

Referring to FIG. 1, the continuous mailer assembly 2 is formed of a plurality of interconnected mailer units 4 which can be folded in a zig-zag manner into a stacked array. As shown, each layer of the stacked array has two mailer units 4 disposed in coplanar relationship.

Figure 3:
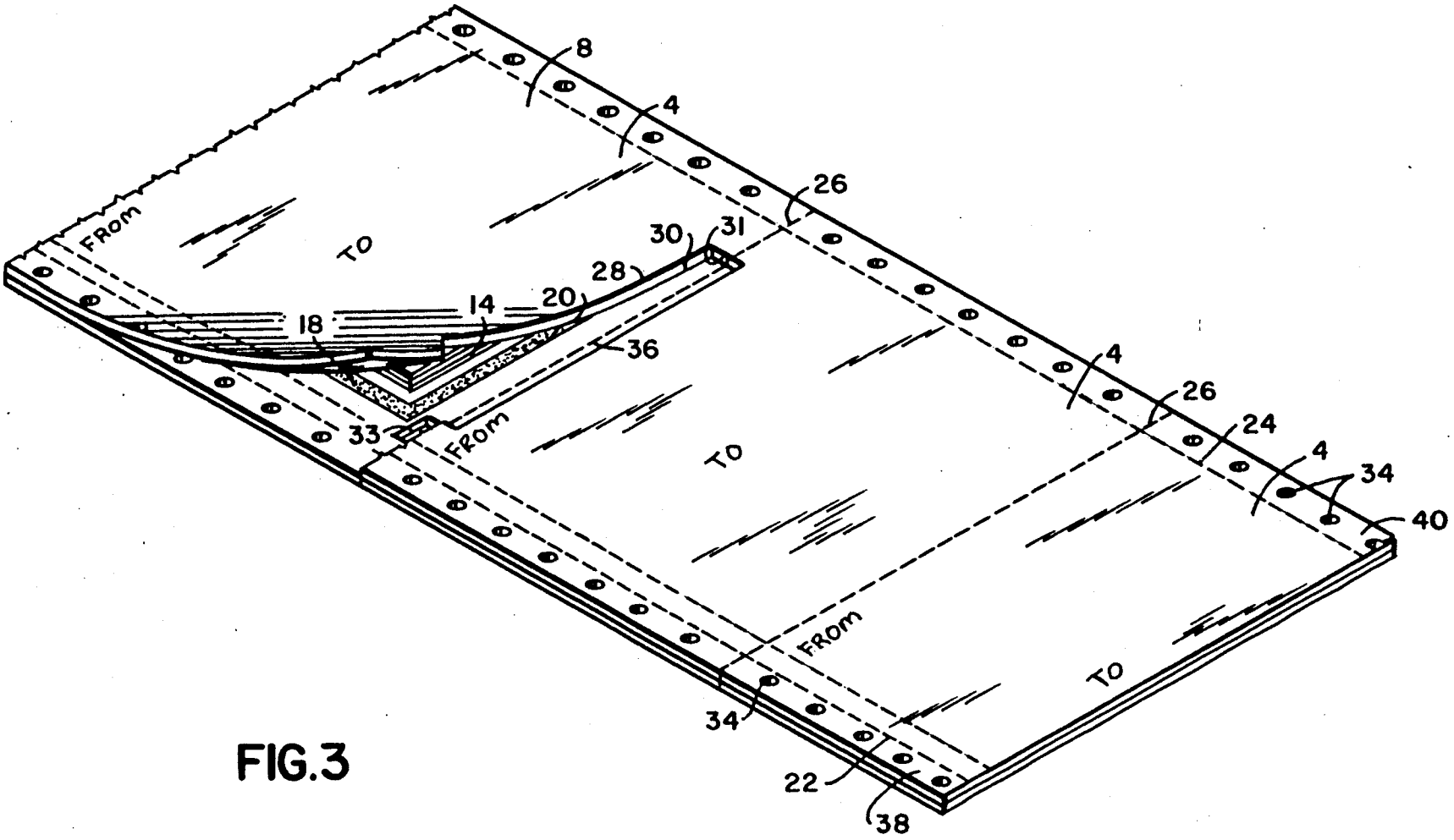
FIG. 3 is a perspective view of an enlarged portion of the assembly showing details of the structure.
Figure 4:
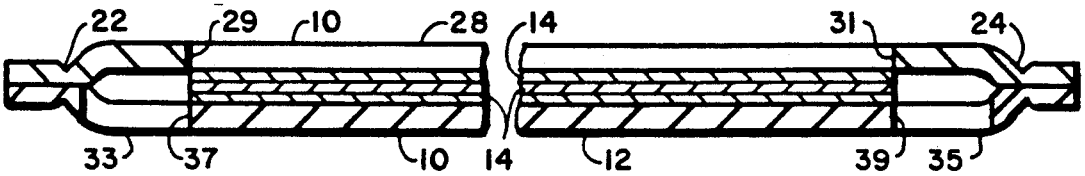
FIG. 4 illustrates a view of a portion of the mailer assembly of FIG. 2, along lines 4—4 of FIG. 2.
Figure 5:
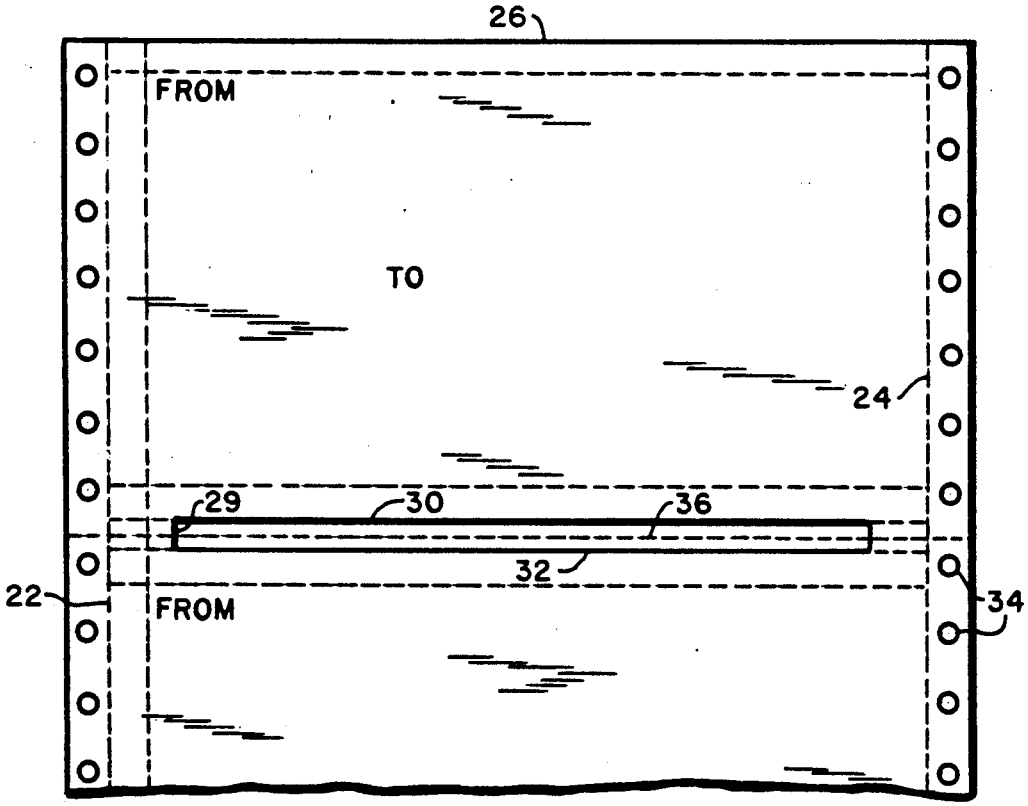
FIG. 5 illustrates a view taken along line 2—2 of FIG. 1 the mailer assembly of FIG. 2.

The mailer assembly 2 is fabricated from continuous webs of paper or the like. As best shown in FIG. 3, one web 6 serves to form a series of front plies 8, a second web 10 forms a series of back plies 12, one or more webs (not shown) are processed to form a plurality (e.g. three) of insert plies 14.

As shown in FIG. 3, each mailer unit 4 includes a front ply 8, a back ply 12 and insert plies 14 between the front and back plies 8, 12. In addition, suitable longitudinal lines 18 and transverse lines 20 of adhesive are provided between the front and back plies 8, and 12 to adhesively secure the plies 8 and 12 together to define an envelope. These lines of adhesive 18 and 20 also serve to frame the insert plies 14 within the envelope defined by the front and back plies 8 and 12 respectively of each unit 4.

In addition, each of the webs 6 and 10 is provided with a longitudinal line of weakening or perforations 22 and 24 on the sides in a known manner so as to provide removable strips 38 and 40 respectively in which pin control holes 34 are located in a known manner.

The individual mailer units 4 are connected to each other via perforated lines 26 and 36 in the respective front and back plies 8 and 12.

In the example shown, the front plies 8 have a transverse die cut opening 28 which is approximately 1/16 inch wide, extending from a point 29 approximately 1 inch inwardly of removable strip perforations 22 on the left side to a point 31 approximately 1 inch inwardly from the corresponding strip of perforations 24 on the right side. The edges are indicated by numbers 30 and 32. The back plies 12 are separated by a transverse single line of perforations 36 and also have transverse die cut strips 33 and 35 1/16 inch wide extending approximately one inch inwardly from each of the strip perforations 22 and 24. The inner edges 37 and 39 of these die strips line up with the ends 29 and 31 of the die cut strip 28 on the front ply 8 so that in effect there is one continuous transverse strip removed.

This may be reversed so that plies 8 have the two short die cuts and the plies 12 the central cut.

The front plies 8 of the adjacent stacked layers are unconnected to each other from point 29 to point 31 while the back plies 12 remain connected in an interrupted manner by the transverse line of perforations 36 and the relatively short die cuts 33 and 35. This permits folding of the mailer assembly 2 while the glue is wet, then drying while in the folded stacked array, and then unfolding after drying without any tenting at the folds and lessens the possibility of the plies tearing as in the case where a single die cut strip is removed on one ply from margin strip to margin strip.

In order to fabricate the mailer assembly 2, the paper webs 6 and 10 are generated to form the front plies 8 and back plies 12, while three additional webs are generated to form the three insert plies 14. In this regard, the webs for forming the insert plies 14 are processed to define longitudinally spaced apart insert sections. This is a known technique.

The webs 6 and 10 are collated into superposed relation in known manner. At this time, the webs forming the front and back plies 8 and 12 are adhered to each other via the lines of adhesive 18 and 20. This also serves to encase the insert plies 14 within the envelopes defined by each respective front ply 8 and back ply 12. In addition the web, not shown, forming the cover sheet is disposed in overlying relation to the front plies 8. Thereafter, all of the superimposed webs are simultaneously perforated at longitudinally spaced intervals to define a series of interconnected mailer units 4 with an overlying cover sheet 16. A single perforation operation is used to form the lines of perforations 26 and 36 in the webs defining the plies 8 and 12. The perforations 26 form small hinges interconnecting in the front plies 8 and back plies 12 and the tear strips 38 and 40.

The simultaneous perforation of all of the superimposed webs is carried out at intervals corresponding to the length of the mailer units 4.

The perforating blades (not shown) are of conventional construction and have, for example four or five teeth per inch with a gap between adjacent teeth of from 0.030 inch to 0.050 inch depending on the strength and type of paper being perforated.

The longitudinal lines of perforations 22 and 24 are formed on each side of the webs 6 and 10 in a known manner before, after or during the transverse perforating of the webs.

After the perforating steps have been carried out, the mailer assembly 2 can then be folded into a stacked array as indicated in FIG. 1.

When plies 8 and 12 are die cut, folding on the transverse perforations is facilitated. The die cut pieces are removed from plies 8 and 12 by a conventional method, allowing for easy folding while wet. When the glue dries in the folded position, the forms will still open flat.

Because the edges of the plies 8 and 12 where the die cuts have been made at the fold areas are not connected to each other, no restraint occurs against folding. Likewise, upon unfolding of the mailer units 4, there is no stressing which tends to create a "tent".

The die cuts may be reversed on plies 8 and 12 and same results would occur.

As is known, a cover sheet and plies 8 and 12 can be provided with various preprinted boxes or other designated areas to receive information which is collated to similar boxes or areas on the insert plies 14. For example, billing data or like information can be typed onto boxes on a cover sheet for transfer onto an insert ply 14 in similarly disposed boxes. This information can be transferred by a suitable image transfer means on the back side of the front ply 8 and insert plies 14.

In use, the mailer assembly 2 can be unfolded from a stack and passed through suitable automatic machinery wherein information can be transferred onto the various plies. To this end, use is made of the pin control holes 34 for feeding the assembly 2 through the machinery. After the information has been affixed on a cover sheet not shown, the cover sheet can be removed and retained, for example, in an account file by the user. The remaining series of interconnected mailers 4 can then be broken apart and mailed separately. When received by an addressee a mailer 4 can be opened and the enclosed insert plies 14 removed for reading.

The invention thus provides a continuous mailer assembly which will not "tent" when unfolded from a stacked configuration, for example, for processing in automatic equipment.

The invention further provides a relatively simple method of forming a tentless continuous mailer assembly wherein existing equipment can be readily retrofitted to carry out the perforating and die cutting operations.

Although the mailing units 4 have been described with the front plies 8 between the cover sheet 16 and back plies 12, the units 4 may also be used in reverse, i.e. with the "front" plies 8 serving as the back plies of the units 4.

Although the invention has been described by reference to an illustrative embodiment, it is not intended that the novel device be limited thereby, but that modifications thereof are intended to be included as falling within the broad spirit and scope of the foregoing disclosure, the following claims and the appended drawings.

What is claimed is:

1. A continuous mailer assembly comprising a plurality of interconnected units disposed in layers in an array, each said unit including a front ply, a back ply secured to said front ply to define an enclosed envelope, at least one insert ply between said front ply and said back ply; each of said back ply being die cut to remove a narrow transverse strip starting at a left marginal strip and extending a short distance to the right and a second narrow transverse strip starting at a right marginal strip and extending a short distance to the left, and each of said front ply being die cut to remove a third narrow transverse strip extending from a short distance from the left margin to a short distance from the right margin, the combined length of the sum of the die cuts on said front and back plies being equivalent to the distance between the left margin and the right margin, each unit being connected to the other only in an interrupted manner the equivalent of one ply between the left margin and the right margin by lines of perforations.

2. A continuous mailer assembly comprising a plurality of interconnected units disposed in layers in an array, each said unit including a front ply, a back ply secured to said front ply to define an enclosed envelope, at least one insert ply between said front ply and said back ply; each of said front ply being die cut to remove a narrow transverse strip starting at a left marginal strip and extending a short distance to the right and a second narrow transverse strip starting at a right marginal strip and extending a short distance to the left, and each of said back ply being die cut to remove a third narrow transverse strip extending from a short distance from the left margin to a short distance from the right margin, the combined length of the sum of the die cuts on said back and front plies being equivalent to the distance between the left margin and the right margin each unit being connected to the other only in an interrupted manner the equivalent of one ply between the left margin and the right margin by lines of perforations..

* * * * *